United States Patent [19]

Takahashi et al.

[11] Patent Number: 5,012,422

[45] Date of Patent: Apr. 30, 1991

[54] CONTROLLING ENGINE FUEL INJECTION

[75] Inventors: Shinsuke Takahashi, Yokohama; Teruji Sekozawa, Kawasaki; Motohisa Funabashi, Sagamihara, all of Japan

[73] Assignee: Hitachi, Ltd., Tokyo, Japan

[21] Appl. No.: 301,363

[22] Filed: Jan. 25, 1989

[30] Foreign Application Priority Data

Jan. 29, 1988 [JP] Japan ..... 63-17062

[51] Int. Cl.[5] ..... F02B 3/00

[52] U.S. Cl. ..... 364/431.050; 73/118.2

[58] Field of Search ..... 364/431.05, 431.07, 364/578; 73/117.3, 118.2

[56] References Cited

U.S. PATENT DOCUMENTS

| | | | |
|---|---|---|---|
| 4,276,600 | 6/1981 | Hartford et al. | 364/431.06 |
| 4,402,294 | 9/1983 | McHugh et al. . | |
| 4,497,297 | 2/1985 | Daniel et al. . | |
| 4,556,942 | 12/1985 | Russo et al. | 364/431.07 |
| 4,616,618 | 10/1986 | Blocher et al. . | |
| 4,664,090 | 5/1987 | Kabasin | 73/118.2 |
| 4,750,352 | 6/1988 | Kolhoff | 73/118.2 |
| 4,899,280 | 2/1990 | Onari et al. | 364/431.05 |

FOREIGN PATENT DOCUMENTS

| | | |
|---|---|---|
| 3721911 | 1/1988 | Fed. Rep. of Germany . |
| 55-148925 | 11/1980 | Japan . |
| 62-121845 | 6/1987 | Japan . |

OTHER PUBLICATIONS

5th. International Conference on Automotive Electronics, vol. 1985, No. 12, Oct. 29, 1985, London, pp. 69–75; Felger & Plapp.

*Primary Examiner*—Parshotam S. Lall
*Assistant Examiner*—Tyrone Queen
*Attorney, Agent, or Firm*—Fay, Sharpe, Beall, Fagan, Minnich & McKee

[57] ABSTRACT

The disclosure concerns the control of fuel injection for automatic control of engines simulating the accuracy of fuel injection control that would be obtained with flow sensors and pressure sensors, without actually employing such sensors. This is true because the theoretical model used for estimating the flow is matched with actual system performance. Maching is obtained by estimating a level of the atmospheric pressure, a flow of air passing through a throttle valve and a flow of air flowing into the cylinder, and controlling the fuel injection based upon the flow of air flowing into the cylinder. The result is a highly accurate estimation of the valves.

31 Claims, 11 Drawing Sheets

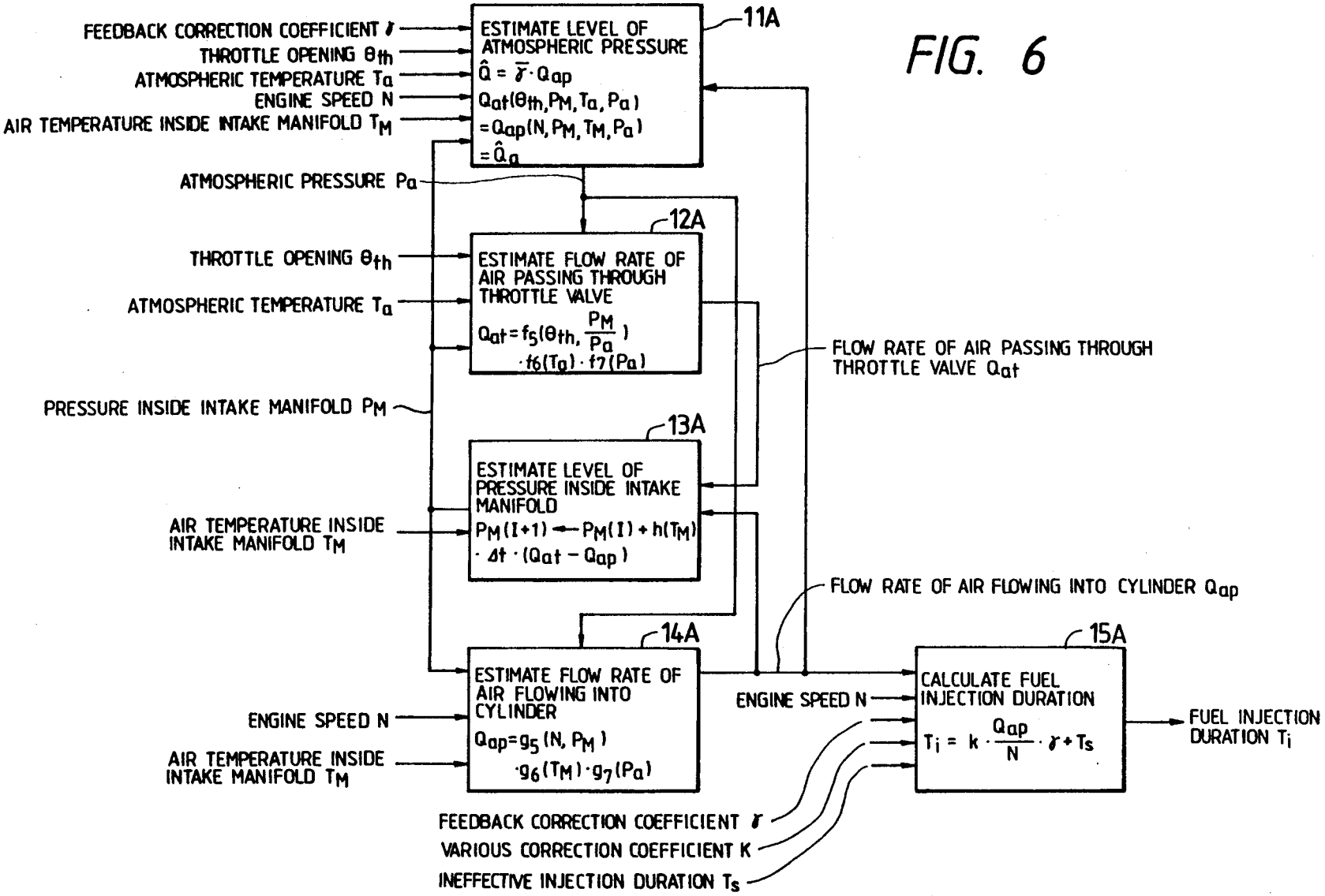
FIG. 6
11A
ESTIMATE LEVEL OF ATMOSPHERIC PRESSURE
$\hat{Q} = \bar{\gamma} \cdot Q_{ap}$
$Q_{at}(\theta_{th}, P_M, T_a, P_a)$
$= Q_{ap}(N, P_M, T_M, P_a)$
$= \hat{Q}_a$
12A
ESTIMATE FLOW RATE OF AIR PASSING THROUGH THROTTLE VALVE
$Q_{at} = f_5(\theta_{th}, \frac{P_M}{P_a}) \cdot f_6(T_a) \cdot f_7(P_a)$
13A
ESTIMATE LEVEL OF PRESSURE INSIDE INTAKE MANIFOLD
$P_M(i+1) \leftarrow P_M(i) + h(T_M) \cdot \Delta t \cdot (Q_{at} - Q_{ap})$
14A
ESTIMATE FLOW RATE OF AIR FLOWING INTO CYLINDER
$Q_{ap} = g_5(N, P_M) \cdot g_6(T_M) \cdot g_7(P_a)$
15A
CALCULATE FUEL INJECTION DURATION
$T_i = k \cdot \frac{Q_{ap}}{N} \cdot \gamma + T_s$
FEEDBACK CORRECTION COEFFICIENT $\gamma$
THROTTLE OPENING $\theta_{th}$
ATMOSPHERIC TEMPERATURE $T_a$
ENGINE SPEED N
AIR TEMPERATURE INSIDE INTAKE MANIFOLD $T_M$
ATMOSPHERIC PRESSURE $P_a$
THROTTLE OPENING $\theta_{th}$
ATMOSPHERIC TEMPERATURE $T_a$
PRESSURE INSIDE INTAKE MANIFOLD $P_M$
AIR TEMPERATURE INSIDE INTAKE MANIFOLD $T_M$
ENGINE SPEED N
AIR TEMPERATURE INSIDE INTAKE MANIFOLD $T_M$
FLOW RATE OF AIR PASSING THROUGH THROTTLE VALVE $Q_{at}$
FLOW RATE OF AIR FLOWING INTO CYLINDER $Q_{ap}$
ENGINE SPEED N
FEEDBACK CORRECTION COEFFICIENT $\gamma$
VARIOUS CORRECTION COEFFICIENT K
INEFFECTIVE INJECTION DURATION $T_s$
FUEL INJECTION DURATION $T_i$

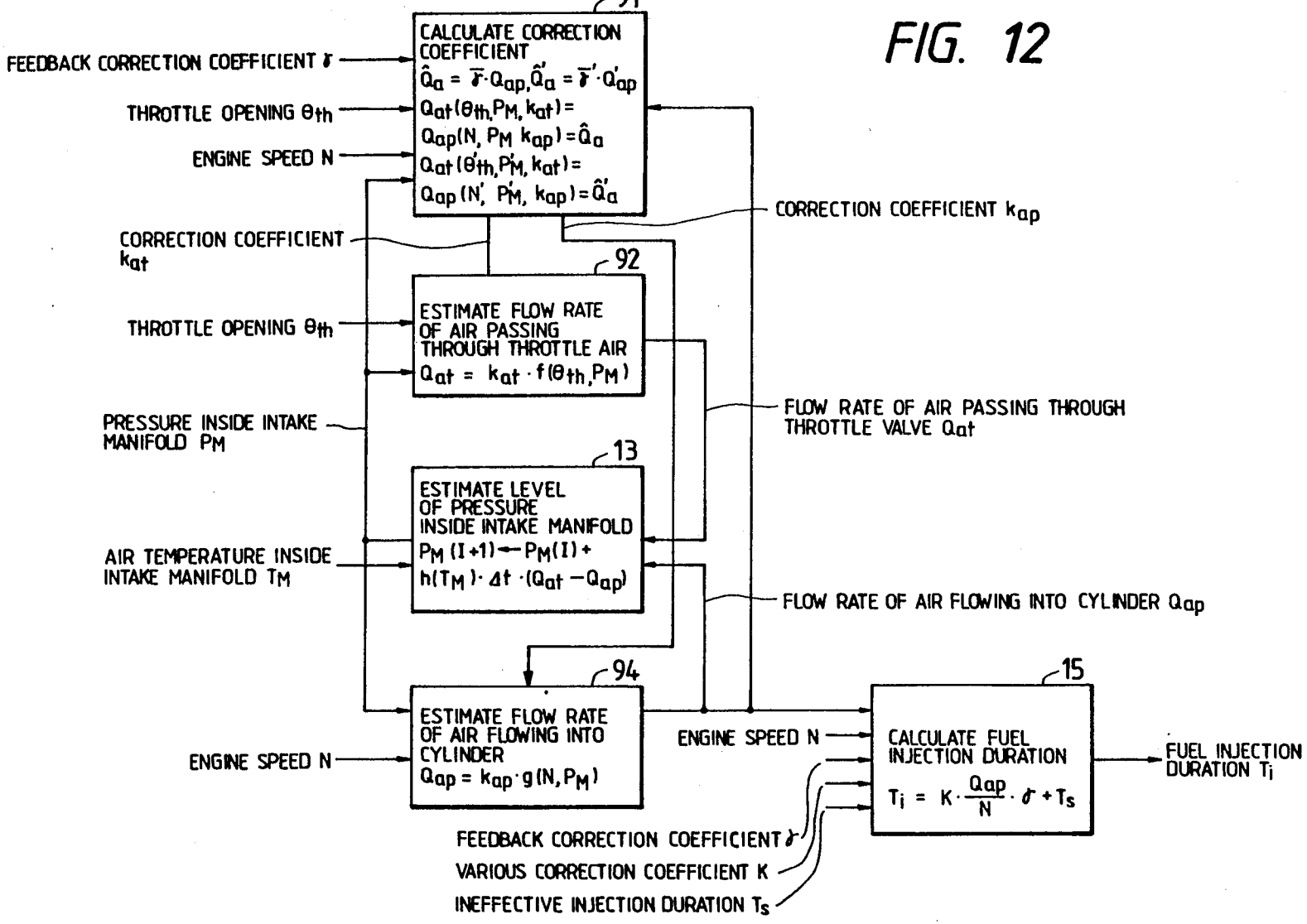
FIG. 12
91
CALCULATE CORRECTION COEFFICIENT
92
ESTIMATE FLOW RATE OF AIR PASSING THROUGH THROTTLE AIR
13
ESTIMATE LEVEL OF PRESSURE INSIDE INTAKE MANIFOLD
94
ESTIMATE FLOW RATE OF AIR FLOWING INTO CYLINDER
15
CALCULATE FUEL INJECTION DURATION
FEEDBACK CORRECTION COEFFICIENT γ
THROTTLE OPENING θth
ENGINE SPEED N
CORRECTION COEFFICIENT kat
THROTTLE OPENING θth
PRESSURE INSIDE INTAKE MANIFOLD PM
AIR TEMPERATURE INSIDE INTAKE MANIFOLD TM
ENGINE SPEED N
CORRECTION COEFFICIENT kap
FLOW RATE OF AIR PASSING THROUGH THROTTLE VALVE Qat
FLOW RATE OF AIR FLOWING INTO CYLINDER Qap
ENGINE SPEED N
FUEL INJECTION DURATION Ti
FEEDBACK CORRECTION COEFFICIENT γ
VARIOUS CORRECTION COEFFICIENT K
INEFFECTIVE INJECTION DURATION Ts

CONTROLLING ENGINE FUEL INJECTION

BACKGROUND OF THE INVENTION

The present invention relates to the control of fuel injection for automotive engines.

Japanese Patent Laid-Open No. 55-148925(1980) estimates a flow of the intake air from information delivered from sensors other than an air flow sensor and other than an internal pressure sensor. That is, the estimation is based upon detected signals related to crank angle, throttle angle, etc. The fuel injection is controlled on the basis of the estimated air flow.

In accordance with SAE paper 810494, it is known to estimate the flow based upon theoretical calculations and employing measured parameters of engine operation.

SUMMARY

It is an object of the present invention to provide a fuel injection control method that enables an engine to be run in a manner similar to the running of an engine wherein an air fuel sensor is employed or an internal pressure sensor is used, without actually employing such expensive sensors. That is, it is an object of the present invention to simulate the accuracy of fuel injection control that would be obtained with flow sensors and pressure sensors, without actually employing such sensors.

The prior art suffers from the problem that the flow of air actually sucked into an engine is not accurately coincident with a theoretical estimation of air flow. Therefore, it is impossible to run an engine based upon such theoretical calculations only in a manner similar to the more accurate conventional running of an engine wherein there are employed expensive and complicated flow sensors and/or internal pressure sensors. More specifically, it is impossible to achieve accurate air-fuel ratio control, with fuel injection, similar to that in the case of employing an air flow sensor or internal pressure sensor from only theoretical estimations. Therefore, both gas purified performance and power performance are deteriorated when theoretical calculations are substituted for measured values of pressure and flow. This is true because the theoretical model used for estimating the air flow is not matched with actual system performance, which matching is an object of the present invention.

The above objects are obtained by estimating a level of the atmospheric pressure, estimating a flow of air passing through a throttle valve, estimating a level of internal pressure within the intake manifold, estimating a flow of the air flowing into the cylinder, and controlling the fuel injection based upon the flow of air flowing into the cylinder. More broadly, it is not necessary to actually estimate the atmospheric pressure. This method is cyclicly repeated throughout the operation of the engine, and manifold pressure is estimated in part upon a previously estimated value of flow, and flow is estimated in part upon a previous estimated value of manifold pressure. Preferably, both throttle flow and piston or cylinder flow are determined.

Actual values of the flow of air passing through the throttle and/or flow of air flowing into the cylinder are determined from the estimated values and information stored with the engine after having previously been experimentally determined at a factory for that particular engine. This factory information is determined from the use of accurate pressure and flow sensors that are used in common for a plurality of different engines to obtain information specific to each engine, which specific engine information is then stored with that particular engine in nonvolatile memory More specifically, since an estimated model or program is on board with each engine and usable with an onboard look-up table for factory measured information, calculated air flow can be matched to actual air flow for a specific engine system. It is therefore possible to accurately determine the air flow for controlling fuel injection, without actually employing any on board pressure sensors or any on board flow sensors.

The level of pressure inside the intake pipe, that is the manifold pressure, is determined from a differential equation deduced from an expression of the conservation of mass of air inside the intake manifold and an ideal gas characteristic equation concerning air inside the intake manifold, while successively renewing the estimated value. Thus, a high accuracy is obtained.

The atmospheric perssure is determined so that the true flow of the intake air calculated from a feedback correction coefficient and an estimated flow of the air flowing into the cylinder during steady-state running is coincident with each estimated air flow rate; and wherein a feedback correction coefficient is calculated by an oxygen sensor output signal.

The estimation of the level of atmospheric pressure by the use of models is respectively provided for estimating a flow of air passing through the throttle valve and estimating a flow of air following into the cylinder, such that the estimated flow of air flowing into the cylinder is related to the true flow of intake air as experimentally previously determined at the factory. Therefore, high accuracy is also obtained by the use of highly accurate models, prior factory experimentally determined stored information, and without the use of expensive on board pressure sensors or flow sensors.

The present invention makes a distinction between variables or parameters that are independent of fluid speed or movement and engine variables or parameters that are dependent upon fluid dynamics. Engine parameters that are independent of fluid speed are not affected by mere movement of the fluid, although they are certainly variable in their own right. These include, for example, atmospheric temperature, manifold air temperature, cooling water temperature, engine speed, engine crank angle, throttle opening or throttle angle, and oxygen content of the exhaust gas. These are to be distinguished from the fluid dynamic air variables or parameters, which include air pressures throughout the engine, for example manifold pressure and atmospheric pressure, and flow of air, including the flow of the air through the throttle and the different flow of air into the cylinder. Flow and pressure are dynamically interrelated, as is well known. Sensors that measure such fluid dynamic variables as pressure and flow are relatively expensive and complicated with respect to a mass produced item such as an automobile. Therefore, it is desirable according to the present invention, to eliminate the use of any on-board fluid dynamic sensors, as air pressure sensors or air flow sensors. The present invention performs calculations of pressure and air flow based upon stored programs and equations together with measured values of engine valuables or parameters that are independent of fluid dynamics. These relatively inaccurate calculations or estimates are corrected according to information stored in a nonvolatile memory and obtained at a factory or other central facility with respect to the specific engine involved for measurements involving the engine variables that are independent of fluid dynamics and accurate measurements of the fluid dynamic variables.

When the throttle valve, for example, is quickly opened, the air flow through the throttle valve corresponding increases and then reduces to a steady value between its peak value and its initial value, due to initially charging the manifold with higher pressure gas. In contrast, the air flow at the cylinder correspondingly increases, but not as far as the air flow at the throttle, and substantially only increases to its steady-state value, where it is held thereafter. That is, there is no overshoot for the air flow at the cylinder. Therefore, estimations based upon air flow at the throttle valve are not accurately correlated to the air flow at the cylinder. It is the air flow at the cylinder that is involved in the air flow ratio. Therefore, the present invention is aimed to calculate and correct air flow at the cylinder, and base the fuel injection control upon the air flow at the cylinder.

Furthermore, actual measurement of air flow (the present invention only actually measures air flow at a factory or other central location in setting up the nonvolatile memory) produces an output signal representative of actual air flow, but considerably delayed.

Preferably, the present invention estimates two air flows, namely the air flow at the throttle and the air flow at the cylinder. These two flows are useful in determining the manifold pressure. A determination of the atmospheric pressure is made to ensure an accuracy of the air estimation when the atmospheric condition changes. It is also for the purpose of more accurately determining the manifold pressure. The manifold pressure is determined based upon the air flow determinations of a previous cycle, whereas the air flow determinations are based upon the manifold pressure from a previous determination (either one may be in a previous cycle or just merely in a previous position in the same cycle).

The present invention employs the air flow into the cylinder to control the injection, rather than the less accurate air flow at the throttle. The present invention further determines the internal pressure or manifold pressure and atmospheric pressure for calculating air flow. The result is a highly accurate estimation of the values. Further, the present invention will correct the estimations or calculations based upon experimental measurements related to the specific engine done at a factory for determining nonvolatile stored data. Therefore, it is possible to make a highly accurate estimation of air flow and operate the fuel injection in accordance with the air flow in a manner as accurate as a system actually employing an air flow sensor or air pressure sensor, without actually employing either such sensors.

BRIEF DESCRIPTION OF THE DRAWINGS

Further objects, features and advantages of the present invention will become more clear from the following more detailed description of a preferred embodiment shown in the accompanying drawing, wherein:

FIG. 6 is a modification of the preferred embodiment previously shown in FIG. 1;

FIG. 12 shows another modification of the system according to FIG. 1;

DETAILED DESCRIPTION OF THE DRAWING

Figure 1:
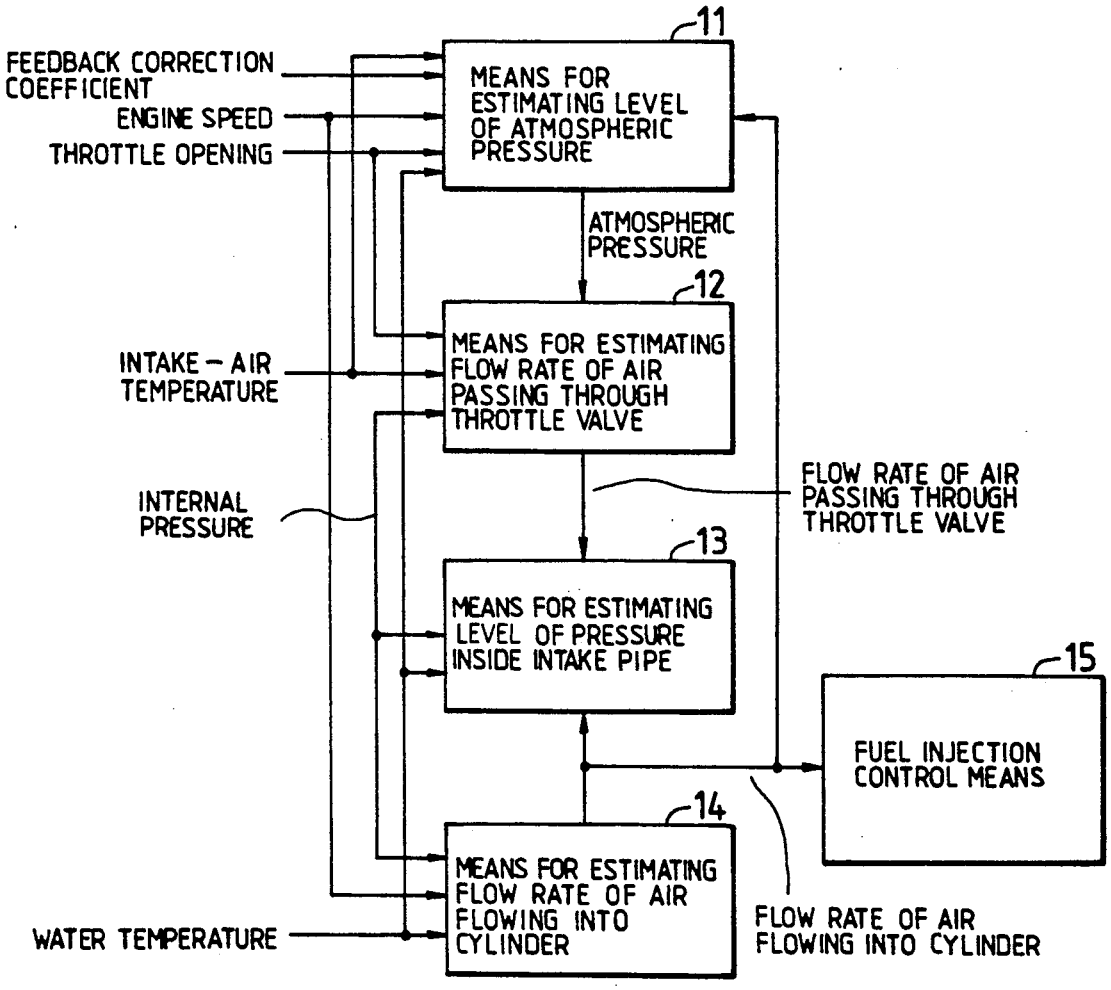
FIG. 1 shows a flow diagram relating to the present invention.

According to FIG. 1, measurements are taken of various engine parameters that are not dependent upon fluid dynamics, namely: water temperature is measured and a corresponding signal is input to Circuit 11 for calculating the atmospheric pressure, input to Circuit 13 for calculating the manifold pressure, and input to Circuit 14 for calculating the air flow into the cylinder; engine speed, N, is measured and a corresponding electrical signal is input to each of the Circuits 11 and 14; intake air temperature Ta is measured and a corresponding electrical signal is input to each of the Circuits 11 and 12; throttle opening Th measured, specifically throttle angle and the corresponding electrical signal is input to each of the Circuits 11 and 12.

In addition, Circuit 11 has inputs of a feedback correction coefficient, a, and airflow into the cylinder, Qap. With this information, Circuit 11 determines the atmospheric pressure Pa, which is output and fed as an input to Circuit 12. Additionally, Circuit 12 receives a signal correlated to the manifold pressure, Pm. With these inputs, Circuit 12 determines and outputs the air flow through the throttle, Qat, which is fed as an input to Circuit 13. Circuit 13 also receives as an input the signal correlated to air flow into the cylinder, Qap. With these inputs, Circuit 13 determines the manifold pressure as an output, Pm, which as mentioned is fed to the Circuit 12 as an input, and which is also fed to Circuit 14 as an input. With its inputs, Circuit 14 determines the air flow into the cylinder, Qap, which is delivered, as mentioned to the inputs of Circuits 11 and 13. In addition, the output of Circuit 14 is fed as an input to .PA Circuit 15 that determines the fuel injection time Ti, together with engine operating parameters, such as engine speed.

Figure 2:
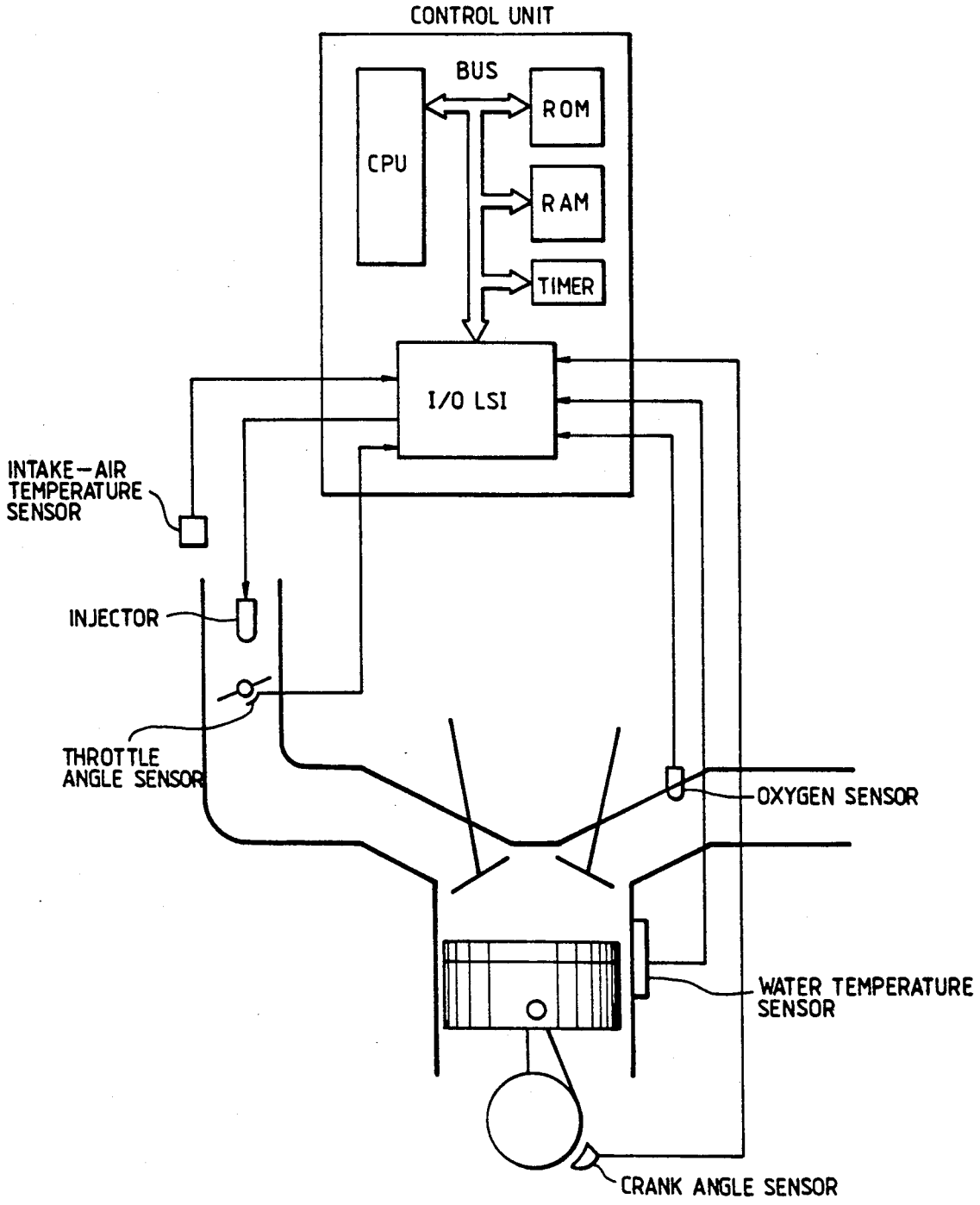
FIG. 2 is a schematic representation of apparatus according to the present invention.

FIG. 2 shows the general arrangement of the embodiment with respect to a specific engine. The engine employs at least on cylinder 1, piston 2, crank 3, crank shaft 4, intake valve 5, exhaust valve 6, throttle valve 7, intake manifold 8, and exhaust manifold 9, all arranged in a conventional manner. Of course, a plurality of such pistons and cylinders may be arranged to be connected to a common throttle valve 7, with each such cylinder having its own intake manifold 8. The temperature of the water cooling the cylinder is measured by sensor 16. Intake air or environmental air temperature is measured by sensor 17, feeding its correlator signal to the I/0 LSI, the input/output large scale integrated circuit 18, which also receives the electrical output signal from the water temperature sensor 16. The degree of opening of the throttle valve, particularly the throttle valve opening angle is determined by sensor 19, and a correlated signal fed to the I/0 circuit 18. Crank angle sensor 20 determines the angular position of the crank, and thus the position of the piston within the cylinder, and produces a correlated electrical signal fed to the I/0 circuit 18, which signal is also indicative of engine speed and therefore the sensor is further an engine speed sensor. The oxygen content of the exhaust gas is measured by sensor 21, which delivers its correlated electrical signal to the I/0 circuit 18.

The I/0 circuit 18 is one part of the controller 22, which includes a bus interconnecting the I/0 circuit 18, ROM 23, RAM 24, central processing unit, CPU, 25 and timer 26 or clock. The I/O circuit 18 outputs a control signal to the conventional fuel injector 27, to control the quantity of fuel injected.

As will be explained later, the ROM stores programs that are executed by the CPU, stores look-up tables that will provide for correction of calculated values in accordance with factory measured values, the RAM provides for temporary storage of data, the clock controls the repeat cycling, and thereby the controller 22 constitutes the Circuits 11, 12, 14 and 15 shown with respect to FIG. 1. The I/0 circuit 18 includes an analog to digital converter and a digital to analog converter. The timer 26 generates a request for interrupt with respect to the CPU periodically to effectively run the programs from the ROM. In response to this request, the CPU executes the control program stored in the ROM. Therefore, the Circuits 11–15 to 51 include the storage and retrieval of data, nonvolatile data, and executable programs.

Figure 7:
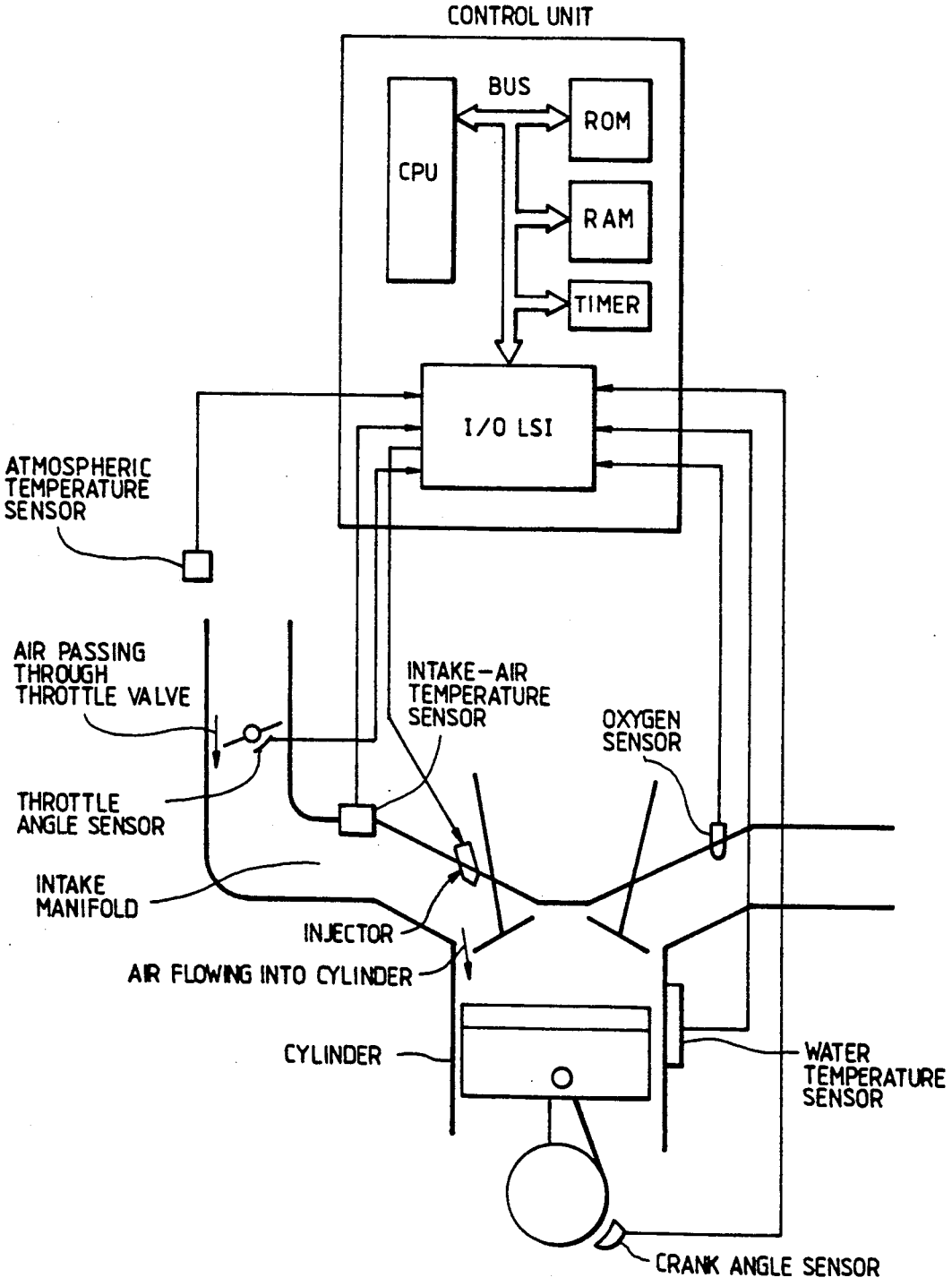
FIG. 7 is a modification of the device shown in FIG. 2.

In FIG. 7 is shown a variation of the apparatus of FIG. 2. In FIG. 7, the fuel injector 27 has been relocated, because its position may be any desirable position for the present invention. In addition, FIG. 7 employs a manifold air temperature sensor 28, for producing a correlated signal Tm fed to the I/0 circuit 18.

In FIG. 6, Circuit 11A differs from Circuit 11 in FIG. 1. Instead of receiving the water temperature as an input, Circuit 11A receives the manifold air temperature Tm from Sensor 28 of FIG. 7. In addition to receiving the feedback signal, Qap, Circuit 11A also receives the feedback signal, Pm, from the output of Circuit 13A. Circuit 12A in FIG. 6 is the same as Circuit 12 in FIG. 1, with the same inputs and outputs. Circuit 13A receives the manifold temperature, Tm, instead of the water temperature, Tw, received by Circuit 13 of FIG. 1. Otherwise, Circuit 13A is identical in inputs and outputs to Circuit 13 in FIG. 1.

Circuit 14A of FIG. 6 receives the manifold air temperature, Tm, as an input instead of the water temperature, Tw, received as an input by Circuit 14 in FIG. 1. In addition, Circuit 14A receives the atmospheric pressure output, Pa, from Circuit 11A as an input. Otherwise, Circuit 14A is similar to Circuit 14 of FIG. 1. Circuit 15A of FIG. 6 receives the additional inputs of the feedback correction coefficient, a, that is also fed to Circuits 11 and 11A, a plurality of correction coefficients indicated as a group by, K, and an ineffective injection duration, Ts. Otherwise, the Circuit 15A also receives the engine speed input, N, and the airflow input, Qap, as does the Circuit 15 of FIG. 1.

Figure 3:
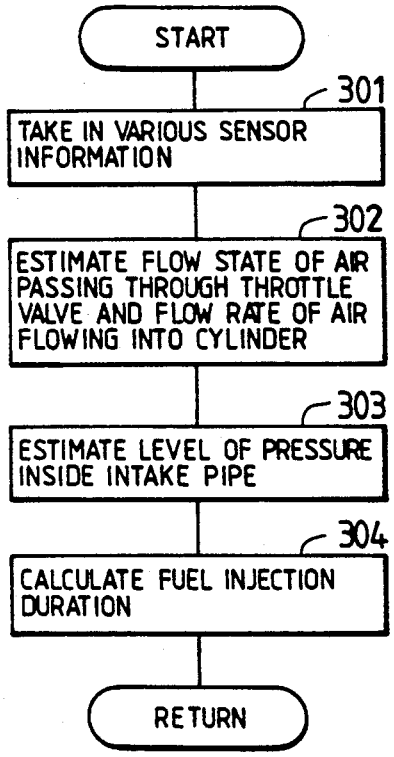
FIG. 3 is a flow chart relating to the execution of a program for the present invention.
Figure 4:
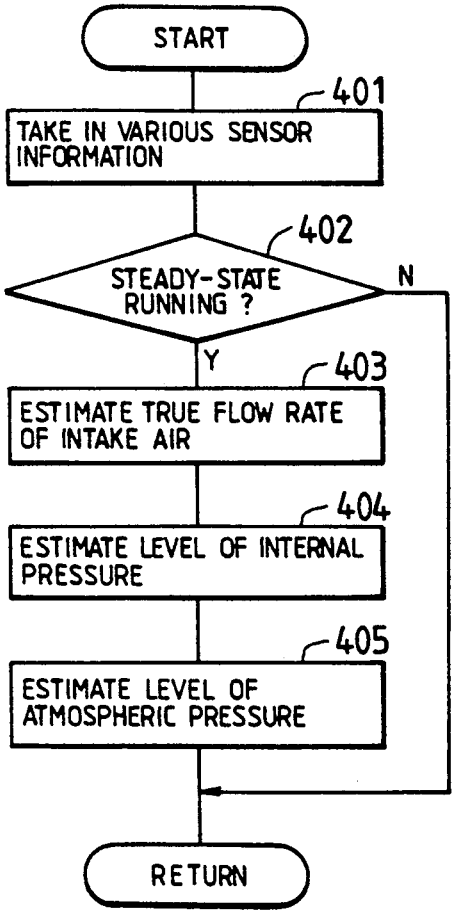
FIG. 4 is flow chart showing the execution of a program relating to the present invention.
Figure 5:
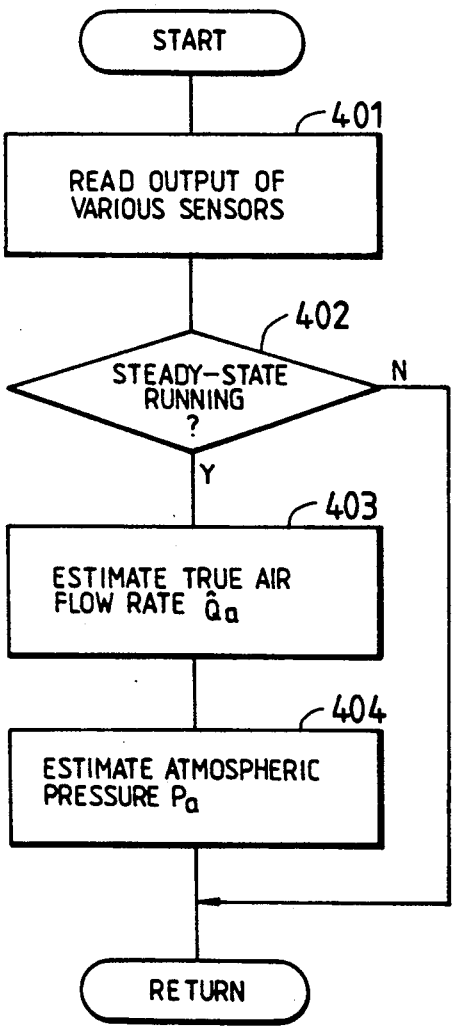
FIG. 5 is a modification of the flow chart shown in FIG. 4.

The operation of the apparatus according to the present invention, that is the method of the present invention relating to execution of the control program stored in the ROM is shown in FIGS. 3, 4 and 5. FIG. 3 is a flow chart of a control program whereby an air flow is estimated and a fuel injection duration is calculated on the basis of the estimated value, while FIG. 4 and 5 are a flow chart of a control program whereby a level of atmospheric pressure is estimated.

The operation of the control program of FIG. 4 or FIG. 5 is equal to that of Circuit 11 of FIG. 1 or Circuit 11A of FIG. 6.

The operation in accordance with execution of the programs according to the program set forth in FIG. 3 will be explained first.

In FIG. 3, the program is started with starting of the engine during normal operation. In Step 301, a request for interrupt is sent out by the timer 26, periodically, so that signals from the sensors that sense the operating parameters of the engine that are not dependent upon fluid dynamics are read out and sent to the 1/0 circuit 18. More specifically, sensors 17, 19, 21, 16, 20 and 28 are read and their corresponding electrical signals are sent through the I/0 circuit 18 for storage in RAM 24 after first being converted to digital form by the A/D converter that is a part of the I/0 circuit 18. These signals may undergo some processing in addition to analog to digital conversion. In Step 302, according to the program read from the ROM, the air flow at the throttle valve, Qat, and the air flow into the cylinder, Qap, are estimated or calculated from the above mentioned sensor values, a previously calculated pressure inside of the manifold, Pm, that was previously calculated in Step 303 of the program and the atmospheric pressure, Pa, as previously calculated in Step 405 of the program in FIG. 4 or 404 in the program as set forth in FIG. 5. The previous calculated values, Pa and Pm, from the execution of the programs in FIGS. 3 and 4 and 5 were temporarily stored in RAM. The calculation according to Step 302 is done with respect to a theoretical expression contained in ROM, and an experimental expression contained in ROM, which experimental expression was entered into ROM at a central location, for example a factory, based upon accurately measured values of fluid dynamic parameters of the operation of this particular engine. Next, according to Step 303, the absolute manifold pressure, Pm, is estimated in accordance with calculations based upon a theoretical expression stored in ROM and various other inputs, such as from the sensors. This value is used in Step 302 in the subsequent request for interrupt. In accordance with the following Step 304, the fuel injection duration, Ti, is calculated according to a program stored in ROM and using engine speed, N, and air flow, Qap, for example. A calculation of fuel injection duration, Ti, is well known and will not be discussed in detail. Thus, the processing is completed and the control process stands by until a subsequent interrupt is generated.

The execution period of the programs of FIG. 4 and 5 is set so as to be considerably longer than the execution period of the control program shown in FIG. 3, or executed at the same time with a coprocessor, or executed at a frequency in multiple of or a division of the frequency of the execution of the program according to FIG. 3. In any event, the program of FIGS. 4 and 5 is started with the starting of the engine. Step 401 corresponds to Step 301 in FIG. 3. In Step 402, it is determined whether or not the engine is operating under steady-state conditions. That is, it is determined whether the change in throttle angle or speed for a change in time is less than some fixed value. That is, the integral of speed or throttle angle is compared with a fixed value to determine if the steady-state condition is present. For example, if a change in throttle angle for a fixed time period is less than some fixed value, it is determined that the steady-state condition exists. Similarly, if the change in engine speed for a fixed time period is less than a fixed value, it is determined that the engine is running in steady-state condition. If the answer to the question in Step 402 is no, the processing is complete and the control process stands by until a subsequent interrupt is generated. When the answer is yes, execution of the program proceeds to Step 403. In Step 403, an estimate is made of the air flow, Qa, as was done in Step 302 in FIG. 3. In Step 405, an estimate is made of atmospheric pressure, Pa, based upon calculations using various inputs. The processing is complete and the control process stands by until a subsequent interrupt is generated.

The actual operation of the Circuits 11–15 in FIGS. 1 and 6 and the operation of the steps set forth in FIGS. 3, 4, and 5 will be described in more detail.

Figure 8:
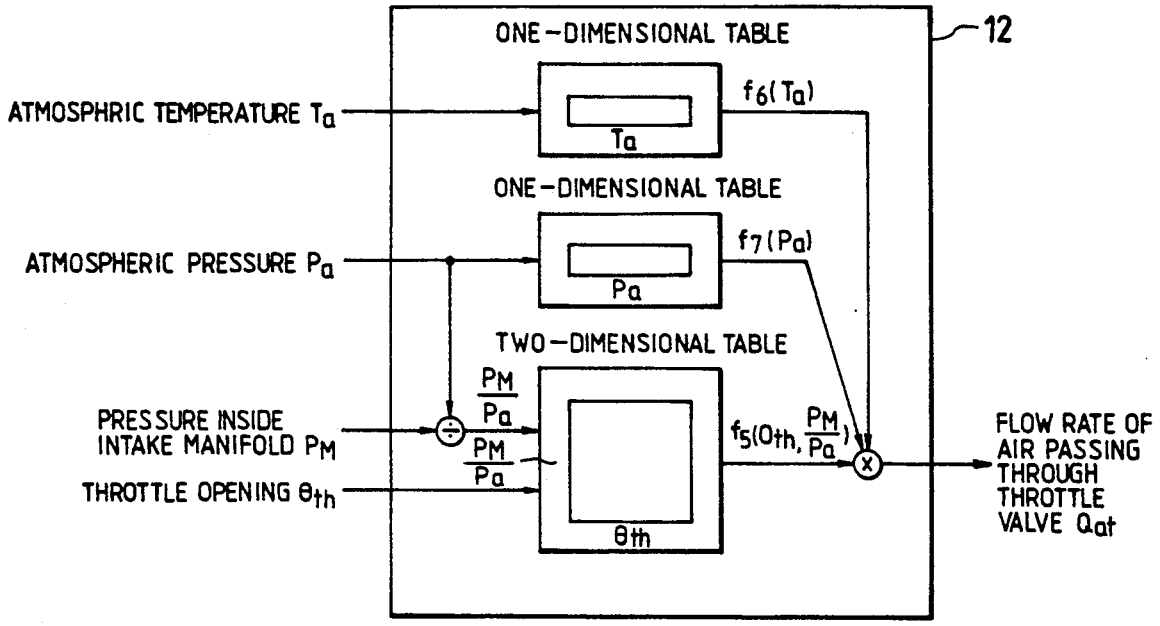
FIG. 8 shows the method of estimating the flow of air passing through the throttle valve.
Figure 9:
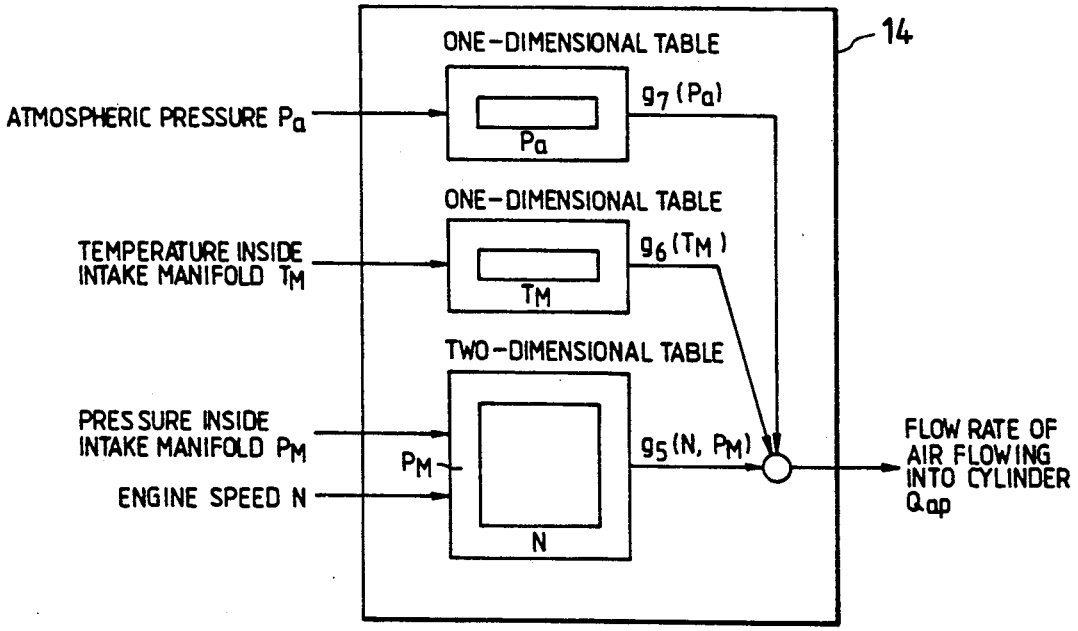
FIG. 9 shows the method of estimating the flow of air flowing into the cylinder.
Figure 10:
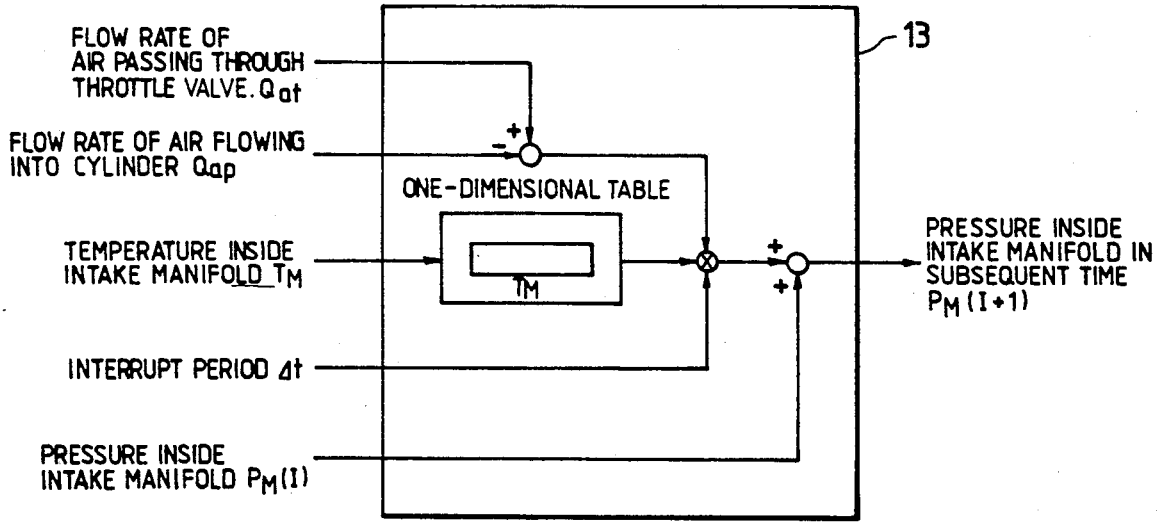
FIG. 10 shows the method of estimating the level of an intake manifold pressure.
Figure 11:
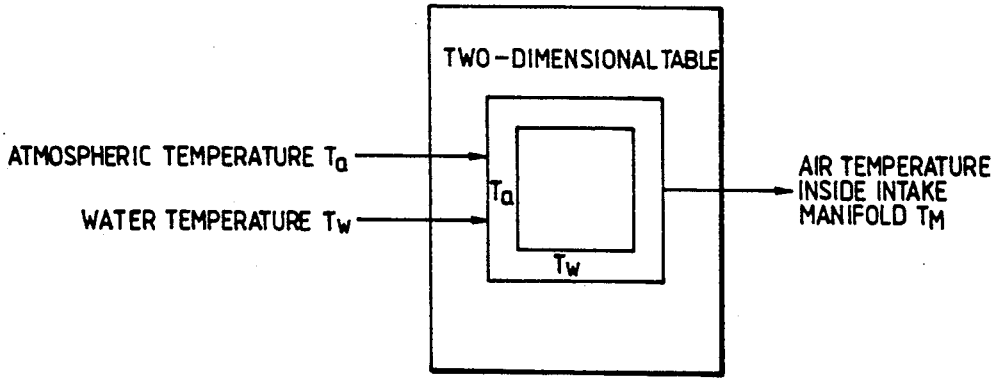
FIG. 11 shows the method of obtaining the air temperature inside the intake manifold indirectly.

Details of Circuit 12 in FIG. 1 and Circuit 12A in FIG. 6 are shown in FIG. 8. The tables are look-up tables contained in ROM and placed there during manufacture of the automobile, as explained previously based upon measured values of fluid dynamic engine parameters, such as pressure and measured values of engine parameters independent of fluid dynamics, such as Ta, and calculated values. The output functions from the table look-ups, labeled functions 6, 7 and 5 are combined, for example multiplied, to produce the circuit output, Qat. In a similar manner, FIG. 9 shows details of Circuit 14A in FIG. 6. The circuit would also represent the details of Circuit 14 in FIG. 1, with the substitution of water temperature for manifold air temperature. Also, Circuit 14 would not have the input of Pa and its corresponding look-up table. FIG. 10 shows details of the Circuit 13A in FIG. 6, and it would be modified as indicated previously to obtain the Circuit 13 for FIG. 1. As previously noted, FIG. 6 involves a value for manifold temperature, which may be obtained with the Sensor 28 shown in FIG. 7, or it may be obtained according to the circuit of FIG. 11 from measured values of atmospheric temperature, Ta, and water temperature, Tw, in accordance with the structure of FIG. 1. In FIG. 11, a look-up table produced with this particular engine at the factory and stored in ROM, is used for this function.

In accordance with Circuit 12 or 12A and Step 302 or 403, the air flow at the throttle valve is determined as follows.

As a theoretical expression used to estimate a flow, Qat, of air passing through the throttle valve, the following expression is obtained from the Bernoulli's theorem of compressible fluid (known):

$$Qat = Cd.A.Pa/\sqrt{Ta}\cdot\sqrt{2k/k-1\cdot g/R\{(Pm/pa)^{2k}-(Pm/pa)^{K+1/k}\}} \quad (1)$$

wherein Cd is a constant; A is the opening area of the throttle valve; Pa is the atmospheric pressure; Ta is atmospheric temperature or intake air temperature; P is the pressure inside the intake manifold or pipe; K is a constant ratio of specific heats (K=1.4 for air); R is a gas constant for air; and g is the acceleration of gravity.

In the above equation, the term 2K/(K−1) may be removed from beneath the square root and placed outside, as is known, to provide a more accurate theoretical expression.

The above expression involves an error because it is deduced according to a physical law. Therefore, the theoretical expression is matched with the actual system and this is done in advance as follows:

Noting the Expression (1) and the fact that the opening area of the throttle valve A is expressed by a function of the throttle opening angle, Th, it will be understood that the flow, Qat, of air passing through the throttle valve is expressed by a product of functions of the throttle opening angle, Th, the ratio Pm/Pa of the intake pipe internal pressure to the atmospheric pressure, Pa, and the atmospheric temperature, Ta, because the other factors are constants.

Therefore, from the variables of Equation 1, the following expression is assumed to be an expression used to estimate a flow of air passing through the throttle:

$$Qat = f1(Th)\times f2(Pm/Pa)\times f3(Pa)\times f4(Ta) \quad (2)$$

To accurately estimate air flow wherein, fi (i=1,2,3,4) is a function of each of the values obtained from a look-up table or from sensors, it is necessary to determine each function f1 to f4 and place it in ROM as tables. The determination is made on the basis of an engine unit test at the factory as follows. If the expression (2) is solved for f1(Th), the following expression is obtained:

$$f1(Th) = Qat/f2(Pm/Pa)\times f3(Pa)\times f4(Ta) \quad (3)$$

It will be understood from expression (3) that, if the engine is factory run upon a test condition that Pm/Pa, Pa and Ta are constant, while changing statically and measuring the throttle opening angle, Th, then fl can be obtained from the measured value Qatl according to the following expressions wherein the various k's are constants:

$$f1(Th) = k1\times Qat1(Th) \quad (4)$$

f2(Pm/Pa), F3(Pa) and f4(Ta) can also be obtained in the same way as follows:

$$f2(Pm/Pa) = k2\times Qat2(Pm/Pa) \quad (5)$$

$$f3(Pa) = k3\times Qat3(Pa) \quad (6)$$

$$f4(Ta) = k4\times Qat4(Ta) \quad (7)$$

With a static change of all the variables through the full operating range of the engine, accomplished at the factory, complete look-up tables can be constructed using expensive and highly accurate fluid dynamic sensors. These fluid dynamic sensors will be commonly used for all the engines tested to produce the individual look-up tables for each engine. Therefore, it will be unnecessary to employ any on board fluid dynamic sensors, such as pressure sensors or flow sensors. Therefore, the cost of these sensors can be eliminated from the mass produced automobiles. This will result in a considerable saving in manufacturing cost and a considerable lessening in complexity for the automobile.

The expressions (4) to (7) are substituted into the expression (2) to obtain the following expression:

$$Qat = k \times Qat1(Th) \times Qat2(Pm/Pa) \times Qat3(Pa) \times Qat4(Ta) \quad (8)$$

$$(k = k1 \times k2 \times k3 \times k4)$$

The constant k in the expression (8) is determined so that a measured value of the flow of intake air at the time when the engine is in a certain steady-state running condition and an estimated value obtained from the expression (8) are coincident with each other.

A flow of air passing through the throttle is estimated by the use of the expression (8), from the various sensor information written into the RAM in Step 301 and the estimated manifold pressure, Pm and the estimated atmospheric pressure, Pa.

Although in the foregoing description a product of functions of one variable, such as the expression (2), is assumed as an expression used to estimate an air flow, the following structures may also be assumed with a view to increasing the degree of accuracy in estimation although the storage capacity required for the ROM increases disadvantageously:

The expression for estimation or calculation is a function of one variable (or value obtained by looking up a one dimensional table) times a function of one variable (or value obtained by looking up a one dimensional table) times a function of two variables (or a value obtained by looking up a two dimensional table), that is a product of various functions. Also, the expression for estimation may be a function of two variables (or values obtained by looking up a two dimensional table) times a function of two variables (or values obtained by looking up a two dimensional table). Alternatively, the expression for estimation may be a function of one variable (or a value obtained by looking up a one dimensional table) times a function of three variables (or values obtained by looking up a three dimensional map). Alternatively, the expression for estimation may be a function of four variables (or a value obtained by looking up a four dimensional table).

It should be noted that determination of a type of function or a data in the table may be made in the same way as in the case where the expression (8) is developed.

It is possible to estimate an air flow with the highest accuracy by the present method to obtain an air flow by looking up the four dimensional table. However, such a method needs a large ROM capacity to store such a four dimensional table; therefore, it is difficult to employ the method with respect to a four dimensional table. It is practical according to the present invention, to calculate air flow from the product of values obtained by looking up values in two dimensional or one dimensional tables. With a two dimensional table, the axis variable, Th, Pm/Pa, the one dimensional table of the axis variable, Ta, and the one dimensional table of the axis variable, Pa, are illustrated in FIG. 8. This takes into consideration the compromise between accuracy and capacity. That is, the highest accuracy is obtained with the greatest memory in ROM, for example with multi-dimensional tables. However, lower accuracy may be tolerated with the advantage of reducing the ROM size, by including various theoretical calculations. The expression for estimation may take on the following form as an alternative for the previously set forth equation or expression (8):

$$Qat = f5(Th, Pm/Pa) \times f6(Ta) \times f7(Pa) \quad (8')$$

When the theoretical expression enables estimation with higher accuracy, estimation is conducted by the use of the theoretical expression rather than employing the experimental expression. For example, in regard to the intake-air temperature Ta in the expression (8), if the theoretical expression enables estimation with higher accuracy, estimation is conducted by the use of the following expression that has the theoretical expression introduced thereinto:

$$Qat = k'Qat(Th)Qat2(Pm/Pa)Qat3(Pa)1/\sqrt{Ta} \quad (9)$$

Next, according to Step 302 an expression that is used to estimate a flow of air flowing into the cylinder is deduced. As an expression for estimation of a flow Qap of air flowing into a cylinder, the following expression is known:

$$Qap = (N/60 \times D \times Vvol \times Pm)/(R \times Tm) \quad (10)$$

wherein R is the gas constant; D is the displacement; Tm is the air temperature inside manifold; N is the engine speed; Pm is the manifold absolute pressure; and Vvol is the volumetric efficiency.

Since the volumetric efficiency is a variable which depends on the manifold pressure, engine speed and atmospheric pressure, the functional structure of Qap is assumed as follows:

$$Qap = g1(N) \times g2(Pm) \times g3(Tm) \times g4(Pa) \quad (11)$$

Determination of each function and the like may be conducted in the same way as in the case where the expression for estimation of Qat is obtained, and the following expression is given:

$$Qap = k'' \times Qapl(N) \times Qap2(Pm) \times Qap3 \times Qap4(Pa) \quad (12)$$

Estimation of a flow of air flowing into the cylinder is made by the use of the expression (12). The practical method of estimating or calculating the air flow is given by FIG. 9, with the reasons set forth above with respect to the air flow through the throttle valve being similar for this estimation. The expression for the estimation may further be given as $$QaP = g5(N, Pm) \times g6(Tm) \times g7(Pa) \quad (12')$$

Next, in Step 303, pressure Pm(k+1), which is to be used in Step 302 during the subsequent interrupt, is calculated from the flow Qat of air passing through the throttle and the flow Qap of air flowing into the cylinder, which have been estimated in Step 302, together with Pm(k) calculated during the previous interrupt and the air temperature inside the intake manifold Tm read in Step 301 air calculated in FIG. 11 according to the following expression:

$$Pm(i+1) = Pm(i) + (R \times Tm)/Vm \times \Delta t \times (Qat - Qap) \quad (13)$$

wherein R is the gas constant; Tm is the air temperature; Vm is the volume of the intake; and $\Delta t$ is the interrupt period.

Instead of the expression (B), the following expression may be used to improve the accuracy of the estimation in the transition.

$$Pm\ (i+1)=Pm(i)+h(Tm)\times\Delta t\times(Qat-Qap) \quad (13')$$

wherein, h(Tm) is (R x Tm}/Vm theorically, but it is determined with the air temperature inside the intake manifold so that the estimated flow of the air flowing into the cylinder is coincident with the measured value in the transient running condition when the throttle angle changes wherein h(Tm) is onedimensional table of which the axis variable is the air temperature Tm inside the intake manifold in the control unit. The method of estimating the manifold pressure by the expression (13)' is shown in FIG. 10.

Finally, in Step 304, a fuel injection duration Ti is calculated according to the following expression on the basis of the estimated flow of air flowing into the cylinder calculated in Step 302:

$$Ti=k'''\times Qap/N\times\gamma+Ts \quad (14)$$

wherein N is the engine speed; k''' is a combination of various correction coefficients; $\gamma$ is a feedback correction coefficient; and Ts is an ineffective injection duration which is useful during start up or as a level.

Thus, the processing is completed, and the control process stands by until a subsequent interrupt is generated.

The following is a description of the operation executed according to the control program to estimate a level of atmospheric pressure with reference to FIG. 4. The operation of the control program is equal to that of Circuit 11. The interrupt period of this control program is set so as to be considerably longer than the interrupt period of the control program shown in FIG. 3 by taking into consideration the fact that the atmospheric pressure does not change suddenly.

First, signals from the crank angle sensor, the throttle angle sensor, the atmospheric temperature sensor and the water temperature sensor are taken in, converted into physical quantities and written into the RAM in Step 401.

Next, it is judged in Step 402 whether or not the engine is in a steady-state running condition by making a judgment as to whether or not the change of the throttle opening and the engine speed in a unit of time is within a predetermined range from the time-series data concerning the throttle opening and the engine speed which have previously been taken. If it is judged that the engine is in a steady-state running condition, the processing in Step 403 is executed.

In Step 403, a true flow Q''a of intake air is calculated from a mean value $\gamma$ of the feedback correction coefficient $\gamma$, which is calculated on the basis of the output of the 02 sensor and corrected periodically according to another control program, and the latest estimated flow Qap of air flowing into the cylinder according to the following expression:

$$a=Qa=\gamma\times Qap \quad (15)$$

Step 404 is a numerical solution used to get internal pressure Pm, so that the true estimated flow Qa of intake air is coincident with a flow Qap (Pm, No, Two) of air flowing into the cylinder obtained by substituting the engine speed No and Two taken in Step 401 into the model provided in the means for estimating a flow of air flowing into the cylinder.

Step 405 is a numerical solution used to get an atmospheric pressure Pa so that the true estimated flow Qa of intake air is coincident with a flow Qat (Pa, Tao, Tho, Pm) of air passing through the throttle valve obtained by substituting the intake-air air temperature Tao, throttle opening Th and internal pressure Pm taken in Step 401 into the model provided in the means for estimating a flow of air passing through the throttle valve, and with the value thus obtained, the estimated atmospheric pressure value stored in the RAM is renewed.

Thus, the processing is complete and the control process stands by until a subsequent interrupt is generated.

The following is a description of the operation executed according to the control program to esitmate a level of atmospheric pressure with reference to FIG. 5.

The operation of the control program is equal to that of Circuit 11A.

The operation of Step 301 to 303 of FIG. 5 is equal to that of FIG. 4 except that in Step 301, the signal from manifold air temperature sensor is taken in.

Further in Step 404 is calculated such a real atmospheric pressure Pa and a real manifold pressure Pm that each estimated air flow Qat, Qap is coincident with the real air flow.

More specifically, it is calculated such that Pa, Pm that satisfies the following equations:

$$Qat(Qth, Pm, Ta, Pa)=Qap(N, Pm, Tm, Pa)-Qa \quad (16)$$

wherein $\overline{Qth}$, $\overline{Ta}$, $\overline{N}$, $\overline{Tm}$, are each the measured value of the throttle opening, the atmospheric temperature, engine speed, and manifold air temperature read in Step 401.

The variables Pa, Pm are each obtained concretely by the following method. The difference between the estimated air flow and the real value is very small, because the atmospheric condition doesn't change suddenly. Therefore, the difference between the estimated manifold pressure Pm or the estimated atmospheric pressure Pa and the real values is also very small. Therefore, approximate equations are satisfied in relation to each pressure.

$$\begin{aligned} Qat(Qth, Pm, Ta, Pa) = {} & Qat(Qth, Pm, Ta, Pa) \\ & + (\partial Qat/\partial Pm)\cdot(Pm - Pm) \\ & \quad Qth = Qth \\ & \quad Pm = Pm \\ & \quad Ta = Ta \\ & \quad Pa = Pa \\ & + (\partial Qat/\partial Pa)\cdot(Pa - Pa) \\ & \quad Qth = Qth \\ & \quad Pm = Pm \\ & \quad Ta = Ta \\ & \quad Pa = Pa \end{aligned} \quad (17)$$

$$\begin{aligned} Qap(N, Pm, Tm, Pa) = {} & Qap(N, Pm, Tm, Pa) \\ & + (\partial Qap/\partial Pm)\cdot(Pm - Pm) \\ & \quad N = N \\ & \quad Pm - Pm \\ & \quad Tm = Tm \\ & \quad Pa = Pa \\ & + (\partial Qap/\partial Pa)\cdot(Pa - Pa) \\ & \quad N = N \\ & \quad Pm = Pm \\ & \quad Tm = Tm \\ & \quad Pa = Pa \end{aligned} \quad (18)$$

The following equation is satisfied in the steady-state running condition.

$$Qat(Qth, Pm, Ta, Pa)=Qap(N, Pm, Tm, Pa) \quad (19)$$

The simultaneous equations of first degree are delivered from the equation (16), (17), (18), (19) and the real manifold pressure Fm and the real atmospheric pressure Fa are calculated by the following expression:

$$Pm=Pm+(N_2=M_2)/(m_1 \cdot N_2-M_2 \cdot N_1) \cdot \Delta Qa \quad (20)$$

$$Pa=Pa+(M_1-N_1)/(M_1 \cdot N_2-M_2 \cdot N_1) \cdot \Delta Qa \quad (21)$$

wherein, $$M_1 = (\partial Qat/\partial Pm), \quad M_2 = (\partial Qat/\partial Pa) \quad (22)$$
$$Qth = Qth \qquad Qth = Qth$$
$$Pm = Pm \qquad Pm = Pm$$
$$Ta = Ta \qquad Ta = Ta$$
$$Pa = Pa \qquad Pa = Pa$$

$$N_1 = (\partial Qap/\partial Pm), \quad N_2 = (\partial Qap/\partial Pa) \quad (23)$$
$$N = N \qquad N = N$$
$$Pm = Pm \qquad Pm = Pm$$
$$Tm = Tm \qquad Tm = Tm$$
$$Pa = Pa \qquad Pa = Pa$$

$$\Delta Qa = Qa - Qat(Qth, Pm, Ta, Pa) \quad (24)$$
$$= Qa - Qap(N, Pm, Tm, Pa)$$

The values of the variables $M_1$, $M_2$, $N_1$, $N_2$ are calculated by the following method.

For example, when the expression (8)' is used to estimate the air flow rate at throttle, the values of the variables $M_1$, $M_2$ are calculated by the following expression:

$$M_1 = 1/Pa \cdot (\partial f_5(Qth, Pm/Pa))/\partial(Pm/Pa) \cdot f_6(Ta) \cdot f_7(Pa) \quad (25)$$
$$Qth = Qth$$
$$Pm = Pm$$
$$Pa = Pa$$

$$M_2 = -Pm/Pa^2 \cdot (\partial f_5(Qth, Pm/Pa)/\partial(Pm/Pa)) \cdot f_6(Ta) \cdot f_7(Pa) \quad (26)$$
$$Qth = Qth$$
$$Pm = Pm$$
$$Pa = Pa$$
$$+ f_5(Qth, Pm/Pa) \cdot f_6(Ta) \cdot f_7'(Pa)$$

wherein, each value of the function $f_5$, $f_6$, $f_7$ is obtained by looking up the tables which are used to calculate the air flow rate at the throttle.

The each value of $\partial f_5(Qth,Pm/Pa)/\partial(Pm/Pa)$, $f_7'(Pa)$ is obtained by looking up the table of which data is precalculated by differentiating the function $f_5$, $f_7$.

The calculation of the variable $N_1$, $N_2$ can be conducted in the same way as described above.

The estimated atmospheric pressure and the manifold pressure stored in the RAM are renewed with the value obtained by the expression (20), (21).

Thus, the processing is complete and the control process stands by until a subsequent interrupt is generated.

The air temperature inside the intake manifold can be indirectly obtained from the measured atmospheric temperature and the measured water temperature. Thus, the cost of the control system can be lowered as the air temperature sensor need not be used. This is possible by the following method. First, when the engine is run in steady-state and the atmospheric temperature and the water temperature are changed staticly in the dynamic range, the air temperature inside the intake manifold is measured. Next, the measured air inside intake manifold is stored in the two-dimensional table in FIG. 11. The air temperature inside the intake manifold is obtained by looking up the table from the measured atmospheric temperature and water temperature.

The structure shown in FIG. 12 can be applied as the method for estimating the air flow. The correction coefficients kat and kap are calculated instead of estimating the atmospheric pressure in this method. The air flow is calculated by those correction coefficients. If the atmospheric condition changes, the values of the correction coefficients change so that the accuracy of estimating the air flow is ensured. The method of estimating each air flow and the method of calculating the correction coefficients are explained. The method of estimating the atmospheric pressure is the same as that shown in FIG. 1. Thus, it is not explained.

Figure 13:
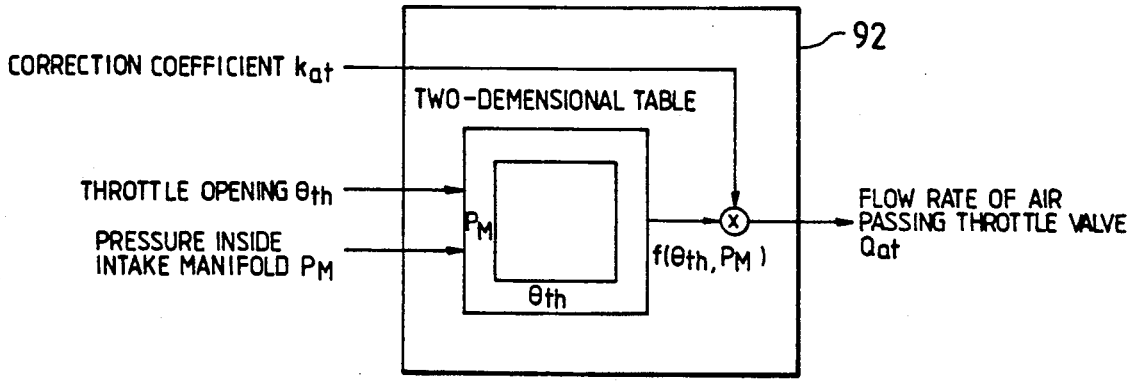
FIG. 13 shows the method of estimating the flow of air passing through the throttle valve for the system of FIG. 12.

In FIG. 13, the representative method of estimating the air flow at the throttle is shown.

In this method, the air flow is calculated from the product of the correction coefficient, kat, and the value f(Th,Pm) obtained by looking up the two-dimensional table. The variables of the axis in the table are the throttle opening and the manifold pressure (a). The calculation of the air flow at the throttle is performed according to the following expression.

$$Qat=kat \times f(Th,Pm) \quad (27)$$

Though the degree of the accuracy in the estimation may decrease, to decrease the storage capacity required for the ROM to memorize the table data, the air flow at the throttle may be also calculated from a product of the correction coefficient kat, two values obtained by looking up two one-dimensional tables in which each axis variable is throttle opening and manifold pressure.

The data of each one-dimensional table is the constant proportional to the air flow at the throttle measured at the time when the axis variable of the table is changed statically in the steady-state running condition so that all variables except the axis variable of the table from the atmospheric pressure, the atmospheric temperature, the throttle opening, the manifold pressure are constant.

The method of estimating the air flow at the throttle on the basis of the measured throttle opening and the estimated manifold pressure is mentioned above.

The following method for the air estimation is also possible, if the engine control apparatus has the atmospheric pressure sensor or atmospheric temperature sensor, etc.

At least, one table of higher dimension than one dimension is provided. The axis variables of all tables are the throttle opening, the manifold pressure, and one of the atmospheric pressure or the atmospheric temperature, at least. Therein, each table does not have the same axis variables. The air flow is calculated from the product of the correction coefficient and all values obtained by looking up the tables. The table data is the constant proportional to the air flow at the throttle measured at the time when the axis variables of the table are changed staticly in the steady-state running condition so that all variables except the axis variables of the table from the atmospheric pressure, the atmospheric temperature, and the axis variables of the all tables are constant.

Next, the method of estimating the flow of the air flowing into the cylinder is explained.

Figure 14:
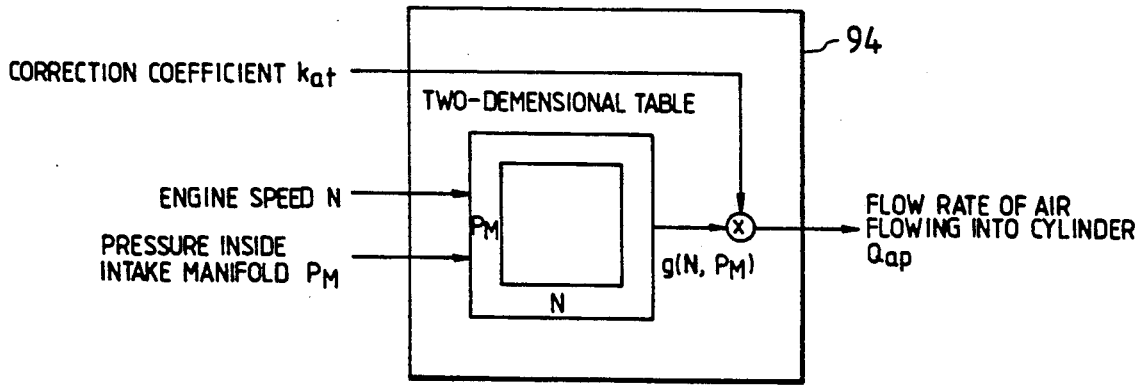
FIG. 14 shows the method of estimating the flow of air flowing into the cylinder in the system of FIG. 12.

In FIG. 14, the representative method of estimating the air flow is shown. The two-dimensional table of which the axis variables are the engine speed and the manifold pressure is provided and the air flow is calculated from the product of the correction coefficient and the values obtained by looking up the two-dimensional table. The table data is the constant proportional to the flow of air flowing into the cylinder measured at the time when the engine speed and the manifold pressure are changed staticly in the steady-state running condition so that the atmospheric pressure and the air temperature inside the intake manifold are constant.

The air flow is calculated by the following expression.

$$Qap = kap \times g(N, Pm) \quad (28)$$

Instead of the two dimensional table, two one-dimensional tables can be provided for the same reason as the two tables are provided in calculation of the air flow at the throttle.

If the control apparatus has the sensor measuring the manifold air temperature, which is the variable contributing to the flow of the air flowing into the cylinder, except the engine speed and the manifold pressure, the tables having the above-described axis variables are provided and the air flow can be calculated in the same way as that of calculating the air flow at the throttle.

Next, the method of calculating the correction coefficients kat and kap, is explained.

The correction coefficients are calculated by the following step. First, it is judged that the engine is in a steady-state running condition when the chance of the throttle opening and the engine speed in a unit of time is within a predetermined range and the true flow rate Qa of the intake air is calculated from a mean value $\gamma$ of the feedback correction coefficient, $\gamma$ which is calculated on the basis of the output of the oxygen sensor according to another control program and the last estimated flow, Qap, of the air flowing into the cylinder according to the following expression.

$$Qa = \gamma \times Qap \quad (29)$$

The calculated true flow, Qa, is memorized in the RAM with the measured throttle opening, Qth, and the measured engine speed, N', and the estimated manifold pressure, Pm, in this steady-state running condition.

Next, when the engine condition changes and comes into another steady-state running condition, the true flow of the intake air is calculated in the same way as the method described above according to the following expression.

$$Qa' = \gamma' \times Qap' \quad (30)$$

Wherein, $\gamma'$ is the mean feedback correction coefficient; Qap' is the estimated flow of air flowing into the cylinder. The measured engine speed, the measured throttle opening, the estimated manifold pressure are $\overline{Qth'}$, $\overline{N'}$ and Pm in the steady-state running condition. These values are memorized in the RAM.

Next, if the two steady-state running conditions appear close (within several minutes), there are calculated such coefficients, kat and kap, that the air flow estimated by the expressions (27) and (28) for the measured throttle opening, engine speed coincides with the real air flow more specifically, the correction coefficients, kat and kap, are such that the following equations are satisfied with our calculation.

$$kat \times f(Qth, Pm) = kap \times g(N, Pm) = Qa \quad (31)$$

$$kat \times f(Qth', Pm') = kap \times g(N' \times Pm') = Qa' \quad (32)$$

Wherein, Pm and Pm' is the real manifold pressure in each steady-state running condition and is the unknown parameter.

As the two running conditions appear closely, the atmospheric condition is constant and the correction coefficient is constant in the two running conditions. This is why the same correction coefficient for estimating air flow in the steady-state running condition is assumed.

Concretely, the correction coefficients are calculated by the following method. As the atmospheric condition does not change suddenly, the difference between the real value of the air flow and the estimated value is very small. Thus, the difference between the real value of the manifold pressure and the estimated value is also small.

Therefore, the following approximate equations are satisfied in regard to the manifold pressure.

$$f(Qth, Pm) = f(Qth, Pm) + (\partial f/\partial Pm) \cdot (Pm - Pm) \quad (33)$$
$$Qth = Qth$$
$$Pm = Pm$$

$$g(N, Pm) = g(N, Pm) + (\partial g/\partial Pm) \cdot (Pm - Pm) \quad (34)$$
$$N = N$$
$$Pm = Pm$$

The following equation is obtained by eliminating the manifold pressure Pm from the equation (31), (33), (34).

$$d/kat - b/kap = (ad - bc)/Qa \quad (35)$$

wherein $$a = f(Qth, Pm),\ b = (\partial f/\partial Pm)$$
$$Qth = Qth$$
$$Pm = Pm$$

$$c = g(N, Pm),\ d = (\partial g/\partial Pm)$$
$$N = N$$
$$Pm = Pm$$

The following equations is obtained in the same way from the equation (32).

$$d'/kat - b'/kap = (a'd' - b'c')/Q'a \quad (36)$$

wherein, $$a' = f(Qth', Pm'),\ b' = (\partial f/\partial Pm)$$
$$Qth = Qth'$$
$$Pm = Pm$$

$$c' = g(N', Pm'),\ d' = (\partial g/\partial Pm)$$
$$N = N'$$
$$Pm = Pm'$$

The correction coefficients kat, kap are calculated from the equation (35) (36) according to the following expressions (37) and (38):

$$kat = (bd' - b'd)/((-ab'd + bb'c)/Qa + (a'bd' - bb'c')/Qa') \quad (37)$$

$$kap = (bd' - b'd)/((-add' + bcd')/Qa + (a'dd' - b'c'd)/Qa') \quad (38)$$

The values of a, a', c, c' are obtained by looking up tables which are used to estimate each air flow rate.

The values of b, b', d, d' are obtained by looking up tables of which each data is $\partial f/\partial Pm$, $\partial g/\partial Pm$.

Next, the general arrangement and the operation of the control program are explained in the case where the method of controlling fuel injection shown in FIG. 12 is realized by the digital control unit.

The general arrangement of the control system is equal to that in FIG. 7 except that the atmospheric temperature sensor need not be used and the injector location is different.

In the ROM of the control unit, are stored the control program whereby an air flow is estimated and a fuel injection duration is calculated on the basis of the estimated valve and are stored so that with another control program the correction coefficients are calculated.

First, the program whereby the fuel injection duration is calculated is explained. The flowchart which shows its operation is equal to that shown in FIG. 3.

First, in response to a request for interrupt generated every predetermined period of time, signals from the throttle angle sensor, the intake air temperature sensor, the water temperature sensor and the crank angle sensor are taken in, converted into physical quantities and written into the RAM in Step 301.

Next, in Step 302, the flow of air passing through the throttle valve and the flow of air flowing into the cylinder are estimated according to the expression (27) and (28) from the above-described physical quantities and the estimated manifold pressure and the correction coefficients calculated by another control program.

Next, in Step 303, the manifold pressure Pm (i+1), which is to be used in Step 302 during the subsequent interrupt is calculated from the air flow Qat, Qap, and the intake manifold pressure Pm (i) calculated during the previous interrupt and the manifold air temperature taken in Step 301 according to expression (13) or (13').

Last, in Step 304, the fuel injection duration is calculated on the basis of the air flow Qap calculated in Step 302 according to the expression (14).

Thus, the processing is completed, and the control process stands by until a subsequent interrupt is generated.

Figure 15:
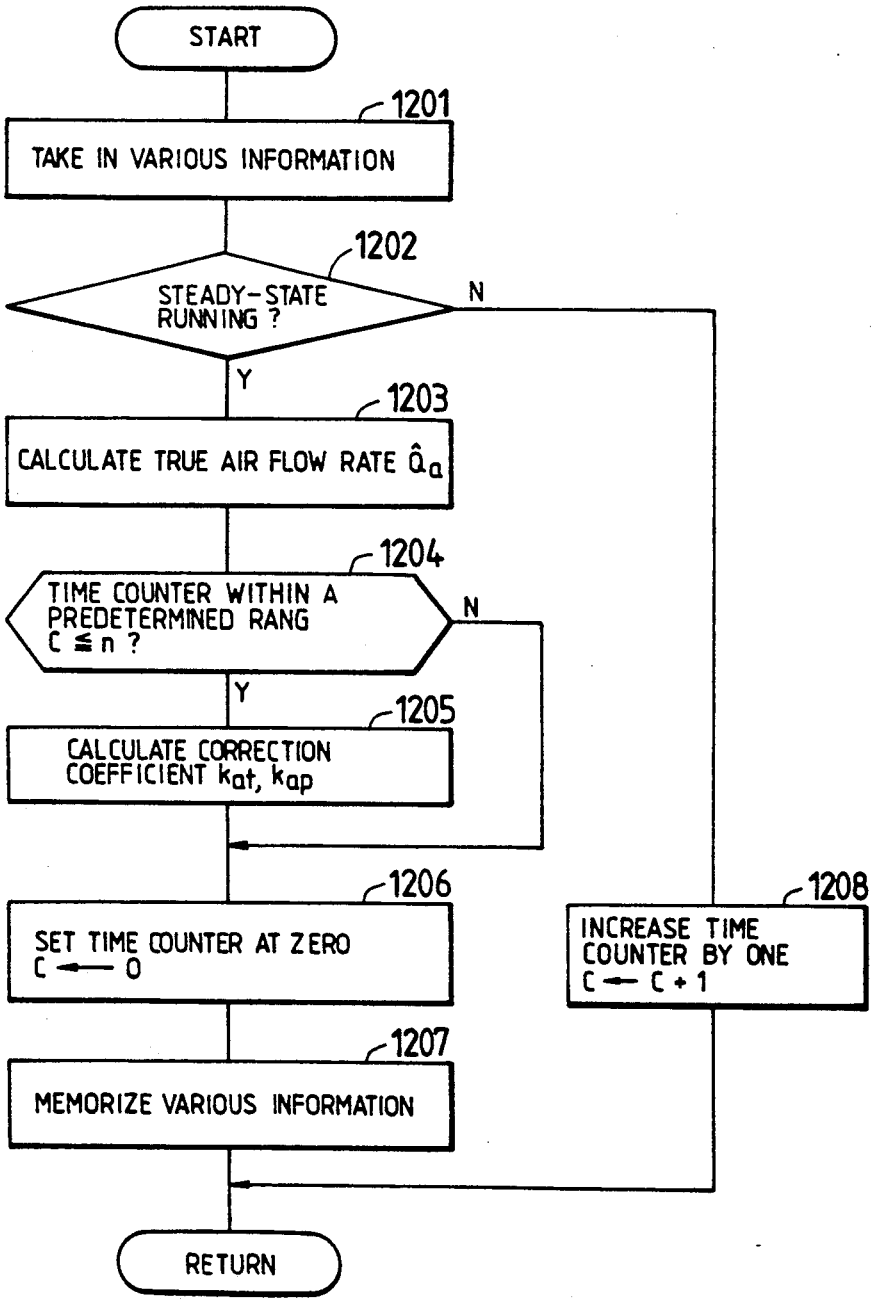
FIG. 15 is a flow chart of the control program to calculate the correction coefficients.

The following is a description of the operation executed according to the control program to calculate the correction coefficients with reference to FIG. 15.

First, in Step 1201, signals from the crank angle sensor, the throttle angle sensor are taken and written into the RAM with the last estimated manifold pressure Pm.

Next, in Step 1202, it is judged whether or not the engine is in a steady-state running condition by making a judgment as to whether or not the change of the throttle opening and the engine speed is within a predetermined range from the time series data concerning the throttle opening and the engine speed, which are taken in at this time and a past time.

If it is judged that the engine is in a steady-state running condition, the processing in Step 1203 is executed. If it is judged that the engine is not in a steady-state running condition, the processing in Step 1208 is executed.

In Step 1208, the time counter, c, is increased by one and the processing is completed; wherein, the time counter, c, is the time interval between the time when it is once judged that the engine is in the steady-state running condition and the time when it is next judged so.

In Step 1203, the true air flow Qa is calculated according to the expression (29) from the estimated air flow Qap and the mean feedback correction coefficient.

Next, in Step 1204, it is judged whether or not the time interval between the present steady-state condition and the previous steady-state condition is within a predetermined time (several minutes) by making a judgment as to whether or not the time counter, c, is within a predetermined time, n. The constant, n, is, for example, set so that, n x $\Delta t$, is several minutes. Wherein, $\Delta t$, is the interrupt interval. If it is judged that the time counter, c, is within the predetermined value, the processing in Step 1205 is executed; if it is not judged so, the processing in Step 1206 is executed. In Step 1205, the correction coefficients are calculated according to the expression (37) and (38) from the engine speed, the throttle opening, the manifold pressure written into RAM in Step 1201, the real air flow calculated in Step 1203 and values of those in the previous steady-state running condition according to expressions.

Next, in Step 1206 the time counter, c, is set at zero.

Last, in Step 1207, the engine speed, the throttle opening, manifold pressure, written into RAM in Step 1201, and the real air flow calculated in Step 1203 are written into another RAM area.

These values are used to calculate the correction coefficients in the subsequent steady-state running condition.

Thus, the processing is completed, and the control process stands by until a subsequent request for interrupt is generated.

As the air flow is calculated on the basis of the output of the throttle angle sensor of which the delay is small in comparison with an air flow sensor or pressure sensor and which is not affected by the air pulsation, the accuracy of the detection of the air flow is improved. Thus, as the transient correction become needless, the period for developing the control system can shorten.

As only several correction levels are provided in the prior transient correction, the sufficient effect of the correction could not be obtained in the various running conditions. As for this problem, the transient correction becomes needless in this invention and the transient control performance can be improved. Thus, the exhaust gas purifying performance and power performance can be improved.

As has been described above, this embodiment enables estimation of an air flow with high accuracy since each model used to estimate an air flow is matched with the actual system in advance. Accordingly, it is possible to run an engine in the same way as in the case where an air flow sensor is used without the need to employ such a sensor.

While preferred embodiments along with variations and modifications have been set forth for disclosing the best mode and important details, further embodiments, variations and modifications are contemplated according to the broader aspects of the present invention, all as set forth in the spirit and scope of the following claims.

What is claimed is:

1. An engine fuel injection control method for use in an electronic fuel injection controller for an engine, which is designed to control the fuel supply quantity by measuring and calculating engine running conditions, said method comprising the steps of:

(A) experimentally determining, at a central location for many engines, the relationship between accurately measured air flow and at least one of engine running conditions over the operating range of the engine;

(B) storing said relationship in a readable look-up table associated with the measured engine;

(C) measuring throttle angle and producing a throttle angle signal;

(D) measuring crank angle and producing a crank angle signal;

(E) measuring water temperature and producing a water temperature signal;

(F) measuring intake air temperature and producing an intake air temperature signal;

(G) measuring the oxygen content in the exhaust gas and producing an oxygen content signal;

(H) calculating an estimated value of the engine running condition from at least some of said signals;

(I) determining the air flow from said look-up table and said calculated value for the engine running condition;

(J) controlling the fuel supply quantity based upon said air flow; and (K) continuously repeating at least one of said steps C, D., E. F. G and said steps H, I, J in order during the running of the engine.

2. The method according to claim 1, wherein said step for calculating includes calculation of said engine running condition based upon said air flow determined from the previous running repetition of the steps.

3. The method according to claim 1, wherein said step of calculating calculates an estimated manifold pressure; and said step of experimentally determining measures the air flow and measures the manifold pressure.

4. The method according to claim 3, wherein said step of experimentally determining includes experimentally accurately measuring manifold pressure, engine speed and engine air flow and placing the relationship between them in one look up table, and further accurately measuring manifold pressure, throttle opening and air flow and placing the relationship between them in a second look up table.

5. An engine fuel injection control method for use in an electronic fuel injection controller for an engine, which is designed to control the fuel supply quantity by measuring and calculating an engine running condition, such method comprising the steps of:

measuring intake air temperature and producing the corresponding intake air temperature signal;

measuring other non-fluid dynamic engine operating parameters and producing corresponding input signals;

calculating an engine air pressure based upon said input signals and a stored program without using any fluid dynamic measurements;

calculating air flow from said calculated air pressure and a stored relationship, without using any fluid dynamic measurements;

controlling the fuel supply quantity on the basis of said calculated air flow; and continuously repeating said steps during running of the engine.

6. The method according to claim 5, wherein said step of calculating air pressure includes calculations based upon the air flow produced from a previous cycle.

7. The method according to claim 6, further including the steps of:

measuring throttle opening and producing a throttle opening signal;

measuring engine speed and producing an engine signal;

said step of calculating air pressure including calculation based upon said throttle opening signal and said engine speed signal.

8. The method according to claim 5, further including the steps of:

measuring throttle opening and producing a throttle opening signal;

measuring engine speed and producing an engine signal;

said step of calculating air pressure including calculation based upon said throttle opening signal and said engine speed signal.

9. The method according to claim 7, wherein said calculated air pressure is manifold air pressure.

10. The method according to claim 7, wherein said calculated air pressure is atmospheric air pressure.

11. An engine fuel injection control method for use in an electronic fuel injection controller for an engine, which is designed to control the fuel supply quantity by measuring and calculating an engine running condition, such method comprising the steps of:

measuring intake air temperature and producing the corresponding intake air temperature signal;

measuring other non-fluid dynamic engine operating parameters and producing corresponding input signals;

calculating manifold air temperature based upon said input signals and a stored program without using any fluid dynamic measurements;

calculating air flow from said calculated manifold air temperature and a stored relationship, without using any fluid dynamic measurements;

controlling the fuel supply quantity on the basis of said calculated air flow; and continuously repeating said steps.

12. The method according to claim 11, wherein said step of calculating air flow includes calculations based upon the air flow produced from a previous cycle.

13. An engine fuel injection control method for use in electronic fuel injection controller for an engine, which is designed to control the fuel supply quantity by measuring and calculating an engine running condition, said method comprising:

experimentally obtaining, at a central location for a plurality of different engines, measured relationships between an engine air pressure and an engine air flow and storing the relationships peculiar to each engine, within the full operating range of the engine, in non-volatile memory;

measuring a plurality of variable engine running conditions, that are independent of fluid speed and producing a corresponding set of input signals;

during user operation of said engine, estimating engine air pressure and determining an air flow from said input signals and said relationships within said non-volatile memory;

controlling the fuel quantity according to said determined air flow; and continuously repeating the cycle of said steps of measuring, determining and controlling during operation of the engine.

14. The method according to claim 13, wherein said step of experimentally obtaining further includes measuring and storing both throttle air flow and separately measuring cylinder air flow.

15. The method according to claim 14, further including calculating an engine running condition based upon the air flow determined during a previous cycle and producing an engine running condition output signal fed as an input to said step of determining, so that the air flow is determined based upon the engine running condition determined in a previous cycle.

16. The method according to claim 15, wherein said step of storing includes storing a table relationship between manifold pressure, throttle angle and throttle air flow, and stores a relationship between manifold pressure, engine speed and cylinder air flow.

17. The method according to claim 16, wherein said step of measuring engine conditions independent of speed include measuring air temperature, measuring cooling water temperature, measuring engine speed, measuring crank angle, measuring throttle angle and measuring oxygen content of the exhaust gas, and producing correlated input signals for each measured value.

18. The method according to claim 13, further including calculating an engine running condition based upon the air flow determined during a previous cycle and producing an engine running condition output signal fed as an input to said step of determining, so that the air flow is determined based upon the engine running condition determined in a previous cycle.

19. The method according to claim 15, wherein said step of storing includes storing a table relationship between manifold pressure, throttle angle and throttle air flow, and stores a relationship between manifold pressure, engine speed and cylinder air flow.

20. The method according to claim 13, wherein said step of measuring engine conditions independent of speed include measuring air temperature, measuring cooling water temperature, measuring engine speed, measuring crank angle, measuring throttle angle and measuring oxygen content of the exhaust gas, and producing correlated input signals for each measured value.

21. A method for controlling the fuel injection of an engine during user operation, comprising:

storing in nonvolatile memory the measured relationship between measured fluid dynamic air variables and measured engine parameters that are independent of fluid dynamics, individually for a plurality of engines over their operating range at a central location with fluid dynamic measuring equipment used commonly for all the engines;

measuring engine conditions that are independent of fluid speed during the normal user operation of the engine and producing correlated input signals;

estimating engine air pressure and calculating an air flow based upon a stored program, the stored relationship, the input signals without the use of on-board measurement of fluid dynamic air variables independent of fluid speed and the calculated engine fluid pressure;

controlling the air-fuel ratio in response to said calculated air flow; and repeating said steps of measuring, calculating and controlling throughout operation of said engine.

22. The method according to claim 21, wherein said step of calculating is based upon the air flow calculation of the previous cycle.

23. The method according to claim 22, wherein said step of measuring engine conditions independent of speed include measuring air temperature, measuring cooling water temperature, measuring engine speed, measuring crank angle, measuring throttle angle and measuring oxygen content of the exhaust gas, and producing correlated input signals for each measured value.

24. A device for indirectly estimating the flow of air flowing into an internal combustion engine, for use in the control of the fuel-to-air ratio during engine running, comprising:

angle detector means for detecting the crank angle of the engine and producing a correlated crank angle signal;

throttle detector means for detecting the opening degree of the throttle and producing a correlated throttle signal;

water temperature detector means for detecting the temperature of the cooling water within the engine and producing a correlated water temperature signal;

air temperature sensor means for detecting the temperature of the air for the engine and producing a correlated air temperature signal;

means for detecting the oxygen content remaining in the exhaust gas for the engine and producing a correlated oxygen content signal;

means responsive to each of said signals for producing a signal correlated to the air flow into the internal combustion engine and producing a correlated estimated air flow signal;

means for storing a plurality of fixed correction factors previously determined at a factory location correlating estimated air flow values with actual air flow values;

means responsive to said estimated air flow signal for correlated correction and producing a corrected air flow signal; and means responsive to said corrected air flow signal for adjusting the air fuel ratio of the engine during operation.

25. An internal combustion engine with air fuel ratio control, comprising:

a plurality of cylinders;

a corresponding plurality of pistons respectively mounted within said cylinders;

a common crank operatively connected to each of said pistons;

air supply means for said cylinders, comprising a throttle valve common to at least two of said cylinders;

cooling means for said engine for circulating cooling water;

means for measuring the temperature of said cooling water and producing a correlated water temperature signal;

means for measuring the crank angle of said crank and producing a correlated crank angle signal;

means for measuring the opening position of said throttle valve and producing a corresponding throttle valve position signal;

means for measuring the temperature of the engine air and producing a corresponding air temperature signal;

means for collecting the exhaust gas from said engine;

means for measuring the oxygen content of the exhaust gas and producing a corresponding exhaust gas signal;

means permanently storing a plurality of stored relationships between non-fluid dynamic engine measured condition signals and actual previously measured air flow values determined experimentally at a factory under corresponding conditions, and storing a calculation program;

control means responsive to said throttle angle signal and at least one other of said signals for producing an estimated engine air pressure and an air flow signal based upon said stored relationships and the stored program;

said control means including a microcomputer; and said control means controlling the air/fuel ratio of the engine based upon said air flow signal.

26. An engine fuel injection control for use in an electronic fuel injection controller for an engine, which is designed to control the fuel supply quantity by measuring and calculating an engine running condition, comprising:

non-volatile means for storing a program and a relationship between measured non-fluid dynamic and fluid dynamic engine conditions over the full operating range of the engine;

means for measuring intake air temperature and producing the corresponding intake air temperature signal;

means for measuring other non-fluid dynamic engine operating parameters and producing corresponding input signals;

means for calculating engine air pressure based upon said input signals and a stored program without using any fluid dynamic measurements;

means for calculating air flow from said calculated engine air pressure and a stored relationship, without using an fluid dynamic measurements; and means for controlling the fuel supply quantity on the basis of said calculated air flow.

27. The control according to claim 26, wherein said means for calculating engine air pressure includes calculations based upon the air flow produced from a previous cycle.

28. An engine electronic fuel injection control, which is designed to continuously control the fuel supply quantity by measuring and calculating an engine running condition, comprising:

an internal combustion engine;

non volatile memory means storing experimentally determining, at a central location for a plurality of different engines, measured relationships between an engine air pressure and an engine air flow relationship peculiar to said engine, within the full operating range of the engine;

means for measuring a plurality variable engine running conditions, that are independent of fluid speed and producing a corresponding set of input signals;

on board means for estimating an engine air pressure and determining an air flow signal from said input signals and said relationship within said non-volatile memory; and means for controlling the fuel quantity according to said air flow signal

29. A device for indirectly estimating the flow of air flowing into an internal combustion engine, for use in the control of the fuel-to-air ratio during engine running, comprising:

angle detector means for detecting the crank angle of the engine and producing a correlated crank angle signal;

throttle detector means for detecting the opening degree of the throttle and producing a correlated throttle signal;

water temperature detector means for detecting the temperature of the cooling water within the engine and producing a correlated water temperature signal;

air temperature sensor for detecting the temperature of the air for the engine and producing a correlated air temperature signal;

means for detecting the oxygen content remaining in the exhaust gas for the engine and producing a correlated oxygen content signal;

means for storing a plurality of fixed relationships previously determined at a factory location correlating estimated air flow values with actual air flow values for the full operating range of the engine;

means responsive to said correlated air temperature signal for estimating engine air pressure;

means responsive to each of said signals, said engine air pressure and said relationships for producing a signal correlated to the air flow into the internal combustion engine and producing a correlated air flow signal; and means responsive to said air flow signal for adjusting the air fuel ratio of the engine during operation.

30. The method according to claim 21, wherein the engine fluid pressure is one of atmospheric pressure and pressure inside intake pipe.

31. The method according to claim 21, further comprising a step of calculating engine fluid pressure based on the measured engine conditions.

* * * * *